US010907491B2

(12) United States Patent
Tyagi et al.

(10) Patent No.: US 10,907,491 B2
(45) Date of Patent: Feb. 2, 2021

(54) SEALING SYSTEM FOR A ROTARY MACHINE AND METHOD OF ASSEMBLING SAME

(71) Applicant: General Electric Company, Schenectady, NY (US)

(72) Inventors: Jagdish Prasad Tyagi, Karnataka (IN); Sendilkumaran Soundiramourty, Karnataka (IN); Amit Grover, Karnataka (IN); Sunil Rajagopal, Karnataka (IN); Rajesh Mavuri, Karnataka (IN); Andrew Paul Giametta, Greenville, SC (US)

(73) Assignee: General Electric Company, Schenectady, NY (US)

( * ) Notice: Subject to any disclaimer, the term of this patent is extended or adjusted under 35 U.S.C. 154(b) by 196 days.

(21) Appl. No.: 15/995,342

(22) Filed: Jun. 1, 2018

(65) Prior Publication Data

US 2019/0162073 A1 May 30, 2019

(30) Foreign Application Priority Data

Nov. 30, 2017 (IN) ..... 2017/41043076

(51) Int. Cl.

| | |
|---|---|
| ***F01D 11/00*** | (2006.01) |
| ***F04D 29/08*** | (2006.01) |
| ***F04D 29/32*** | (2006.01) |
| *F01D 5/30* | (2006.01) |

(52) U.S. Cl.

CPC ..... *F01D 11/008* (2013.01); *F04D 29/083* (2013.01); *F04D 29/321* (2013.01); *F01D 5/3007* (2013.01); *F05D 2230/60* (2013.01); *F05D 2240/55* (2013.01); *F05D 2240/80* (2013.01); *F05D 2260/30* (2013.01)

(58) Field of Classification Search

CPC .... F01D 11/005; F01D 11/006; F01D 11/008; F01D 5/3007; F04D 29/321; F04D 29/083; F05D 2240/55; F05D 2260/30; F05D 2230/60; F05D 2240/57

USPC ..... 416/198 A; 415/139

See application file for complete search history.

(56) References Cited

U.S. PATENT DOCUMENTS

| | | | | | |
|---|---|---|---|---|---|
| 2,755,063 | A * | 7/1956 | Wilkinson | F01D 5/3015 | 416/221 |
| 4,189,282 | A * | 2/1980 | Benoist | F01D 5/3015 | 416/193 A |
| 4,524,980 | A * | 6/1985 | Lillibridge | F01D 11/008 | 277/641 |
| 4,919,590 | A | 4/1990 | Stratford et al. | | |
| 5,167,485 | A * | 12/1992 | Starkweather | F01D 11/005 | 415/115 |

(Continued)

*Primary Examiner* — J. Todd Newton

(74) *Attorney, Agent, or Firm* — Armstrong Teasdale LLP

(57) ABSTRACT

A sealing system for a rotary machine is provided. The sealing system includes a pair of circumferentially-adjacent rotary components and an axial seal. Each of the rotary components includes a platform including a first side channel and an opposite second side channel, a shank extending radially inwardly from the platform, and a dovetail region extending radially inwardly from the shank. The axial seal is sized and shaped to be received in the first side channel of a first of the rotary components and the second side channel of a second of the rotary components, such that the axial seal sealingly interfaces with the first and second channels.

20 Claims, 9 Drawing Sheets

(56) References Cited

U.S. PATENT DOCUMENTS 5,211,407 A 5/1993 Glynn et al.
5,513,955 A * 5/1996 Barcza ..... F01D 5/22 416/193 A
5,707,207 A * 1/1998 Benoist ..... F01D 11/005 277/415
5,735,671 A * 4/1998 Brauer ..... F01D 11/008 416/95
5,957,658 A 9/1999 Kasprow et al.
6,273,683 B1 * 8/2001 Zagar ..... F01D 5/22 416/193 A
6,315,298 B1 * 11/2001 Kildea ..... F01D 11/006 277/433
6,340,285 B1 * 1/2002 Gonyou ..... F01D 11/005 415/116
6,398,499 B1 6/2002 Simonetti et al.
6,561,764 B1 * 5/2003 Tiemann ..... F01D 5/3015 416/193 A
6,883,807 B2 4/2005 Smed
7,052,240 B2 5/2006 Race et al.
7,407,370 B2 8/2008 Bracken et al.
8,002,286 B1 * 8/2011 El-Aini ..... F01D 11/02 277/412
8,182,208 B2 * 5/2012 Bridges, Jr. ..... F01D 11/005 415/139
8,602,737 B2 * 12/2013 Garcia-Crespo ..... F01D 11/006 416/204 R
8,684,695 B2 4/2014 Walunj et al.
9,840,931 B2 * 12/2017 Joshi ..... F16J 15/0887
9,845,690 B1 * 12/2017 Giametta ..... F01D 9/023
2002/0090296 A1 * 7/2002 Kuwabara ..... F01D 11/005 415/169.1
2007/0025837 A1 * 2/2007 Pezzetti, Jr. ..... F01D 11/005 415/115
2009/0092485 A1 * 4/2009 Bridges, Jr. ..... F16J 15/0887 415/173.7
2009/0169369 A1 * 7/2009 Morgan ..... F01D 9/023 415/174.2
2010/0129226 A1 * 5/2010 Strohl ..... F01D 5/3007 416/219 R
2010/0272559 A1 * 10/2010 Propheter-Hinckley ..... F01D 11/005 415/173.1
2011/0014050 A1 * 1/2011 Lake ..... F16J 15/0887 416/204 A
2012/0189424 A1 * 7/2012 Propheter-Hinckley ..... F01D 11/005 415/1
2012/0219405 A1 * 8/2012 Szwedowicz ..... F16J 15/0887 415/173.3
2014/0030100 A1 * 1/2014 Joshi ..... F01D 5/22 416/219 R
2015/0001815 A1 * 1/2015 Steiger ..... F01D 11/005 277/649
2015/0125304 A1 * 5/2015 Rapp ..... F01D 11/008 416/190
2015/0361814 A1 * 12/2015 Bluck ..... F01D 11/006 416/183
2016/0017716 A1 * 1/2016 Haggmark ..... B23H 9/10 415/208.1
2016/0281521 A1 * 9/2016 Clum ..... F16J 15/02
2016/0298480 A1 * 10/2016 Bluck ..... F01D 5/02
2017/0022839 A1 * 1/2017 Lewis ..... F01D 11/08
2017/0350263 A1 * 12/2017 Giametta ..... F01D 11/006
2018/0149025 A1 * 5/2018 Thistle ..... F01D 5/22
2018/0187558 A1 * 7/2018 Thistle ..... F01D 11/006
2018/0187559 A1 * 7/2018 Thistle ..... F01D 5/26
2018/0187562 A1 * 7/2018 Thistle ..... F01D 5/22
2018/0195401 A1 * 7/2018 Sippel ..... F01D 11/005
2018/0274381 A1 * 9/2018 Dooley ..... F01D 5/30
2018/0283193 A1 * 10/2018 Walker ..... F16J 15/0806
2019/0162073 A1 * 5/2019 Tyagi ..... F04D 29/083

* cited by examiner

SEALING SYSTEM FOR A ROTARY MACHINE AND METHOD OF ASSEMBLING SAME

CROSS REFERENCE TO RELATED APPLICATIONS

This application claims priority to and the benefit of the filing date of IN Patent Application Serial No. 2017/41043076, filed Nov. 30, 2017, which is hereby incorporated by reference and is assigned to the assignee of the present application.

BACKGROUND

The field of the disclosure relates generally to rotary machines, and more particularly to a sealing system for a rotary machine.

At least some known rotary machines include a compressor, a combustor coupled downstream from the compressor, a turbine coupled downstream from the combustor, and a rotor shaft rotatably coupled between the compressor and the turbine. Some known compressors include at least one rotor disk coupled to the rotor shaft, and a plurality of circumferentially-spaced rotary components (e.g. compressor blades, axial spacers) that extend outward from each rotor disk to define a stage of the compressor. At least some known rotary components include a platform, a shank that extends radially inward from the platform, and a dovetail region that extends radially inward from the shank to facilitate coupling the rotary component to the rotor disk.

In some machines, a clearance gap is defined between laterally-adjacent platforms of rotary components in a stage to enable assembly of the row of rotary components and to account for dimensional changes of the rotary components during operation of the compressor. However, the efficiency of at least some compressors may be limited, at least partially as a result of the clearance between adjacent rotary components, by working fluid leakage to and from the main flow path in the front stages of a compressor of a rotary machine. As such, at least some known rotary component designs are modified to reduce the clearance between platforms of laterally-adjacent rotary components. However, at least some of such known modifications to the rotary component designs may inhibit assembly of a stage of rotary components and/or may have limited effectiveness in reducing flow path leakage between laterally-adjacent rotary components.

BRIEF DESCRIPTION

In one aspect, a sealing system for a rotary machine is provided. The sealing system includes a pair of circumferentially-adjacent rotary components and an axial seal. Each of the rotary components includes a platform including a first side channel and an opposite second side channel, a shank extending radially inwardly from the platform, and a dovetail region extending radially inwardly from the shank. The axial seal is sized and shaped to be received in, and sealingly interface with, the first side channel of a first of the rotary components and the second side channel of a second of the rotary components.

In another aspect, a rotor assembly for a rotary machine is provided. The rotor assembly includes a row of rotary components spaced circumferentially about a rotor disk and a plurality of axial seals. Each rotary component includes a platform including a first side channel and an opposite second side channel, a shank extending radially inwardly from the platform, and a dovetail region extending radially inwardly from the shank. Each of the axial seals is sized and shaped to be received in, and sealingly interface with, the first side channel of one of the rotary components and the second side channel of an adjacent one of the rotary components.

In yet another aspect, a method of assembling a rotor assembly is provided. The method includes coupling a plurality of rotary components in a circumferentially extending row of rotary components. Each rotary component includes a platform including a first side channel and an opposite second side channel, a shank extending radially inwardly from the platform, and a dovetail region extending radially inwardly from the shank. The method also includes receiving each of a plurality of axial seals within the first side channel of one of the rotary components and the second side channel of an adjacent one of the rotary components in the row, each of the axial seals sized and shaped to sealingly interface with the first and second side channels.

DETAILED DESCRIPTION

The embodiments described herein overcome at least some of the disadvantages of known rotary components. The embodiments include a rotary component platform including a first side channel and an opposite second side channel. The first and second side channels of circumferentially-adjacent rotary components cooperate to receive, and sealingly interface with, an axially-extending seal to facilitate reducing working fluid leakage between the adjacent rotary components. In at least some embodiments, working fluid leakage reduction is achieved without modifying the existing rotor disk and/or rows of axially-adjacent rotary components, such as rotor blades. Alternatively, a portion of a downstream rotary component platform is modified to facilitate retaining the axial seal within the rotary component side channels. Additionally or alternatively, in certain embodiments, the rotary component includes a channel restriction coupled to a downstream face of the rotary component to facilitate retaining the axial seals within the side channels.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by a term or terms such as "about," "approximately," and "substantially" is not to be limited to the precise value specified. In at least some instances, the approximating language may correspond to the precision of an instrument for measuring the value. Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item. As used herein, the term "upstream" refers to a forward or inlet end of a rotary machine, and the term "downstream" refers to an downstream or exhaust end of the rotary machine.

Figure 1:
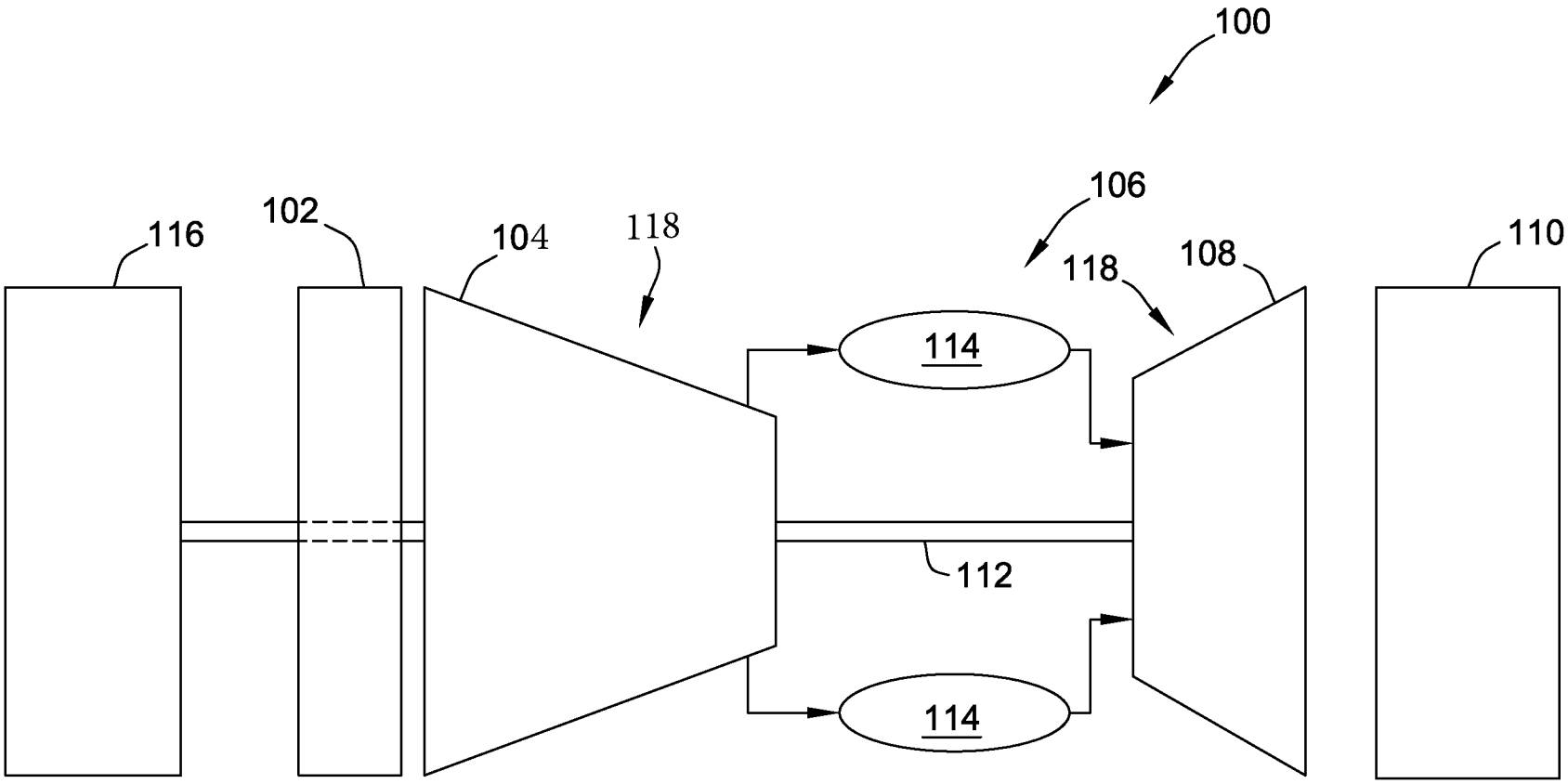
FIG. 1 is a schematic view of an exemplary rotary machine.

FIG. 1 is a schematic view of an exemplary rotary machine 100. In the exemplary embodiment, rotary machine 100 is a gas turbine engine. Alternatively, rotary machine 100 may be any other turbine engine and/or rotary machine, including, without limitation, a steam turbine engine, a gas turbofan aircraft engine, other aircraft engine, a wind turbine, a compressor, and a pump. In the exemplary embodiment, gas turbine 100 includes an intake section 102, a compressor section 104 that is coupled downstream from intake section 102, a combustor section 106 that is coupled downstream from compressor section 104, a turbine section 108 that is coupled downstream from combustor section 106, and an exhaust section 110 that is coupled downstream from turbine section 108. Turbine section 108 is coupled to compressor section 104 via a rotor shaft 112. In the exemplary embodiment, combustor section 106 includes a plurality of combustors 114. Combustor section 106 is coupled to compressor section 104 such that each combustor 114 is in flow communication with compressor section 104. Turbine section 108 is also coupled to a load 116 such as, but not limited to, an electrical generator and/or a mechanical drive application. In the exemplary embodiment, each of compressor section 104 and turbine section 108 includes at least one rotor assembly 118 that is coupled to rotor shaft 112.

Figure 2:
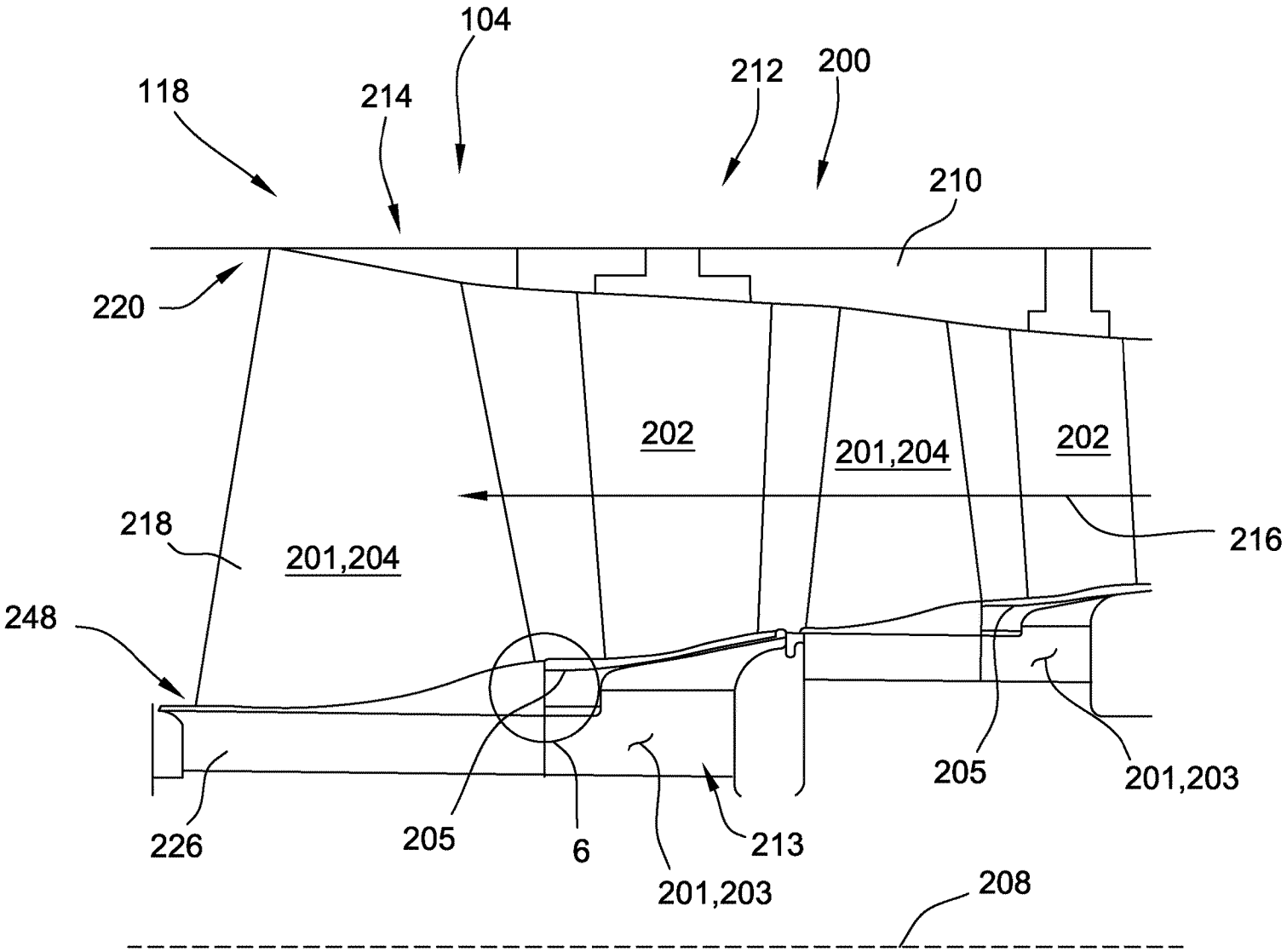
FIG. 2 is a partial sectional view of a portion of an exemplary rotor assembly that may be used with the rotary machine shown in FIG. 1.

FIG. 2 is a sectional view of a portion of an exemplary rotor assembly 118. In the exemplary embodiment, compressor section 104 includes a plurality of stages 200 that each include a row 212 of stator vanes 202, a row 214 of rotating blades 204, a row 213 of rotating axial spacers 203, and a plurality of axial seals 205 positioned between adjacent pairs of rotary components 201. More specifically, in the exemplary embodiment, rotary components 201 are row 213 of axial spacers 203. In another embodiment, rotary components 201 are row 214 of rotating blades 204. Alternatively, rotary components 201 may be any other rotating components of rotary machine 100 that enable axial seals 205 to function as described herein.

In the exemplary embodiment, blades 204 in each row 214 are spaced circumferentially about, and extend radially outward from, a rotor disk 206. Each rotor disk 206 is coupled to rotor shaft 112 (shown in FIG. 1) and rotates about a centerline axis 208 defined by rotor shaft 112. Each blade 204 includes an airfoil 218 that extends radially between a root end 248 and a tip end 220. Each blade 204 also includes a platform 226 radially inward of root end 248. Axial spacers 203 in each row 213 are spaced circumferentially about, and extend radially outward from, rotor disk 206. Axial seals 205 extend axially between circumferentially-adjacent axial spacers 203 in row 213 or, alternatively, between adjacent blades 204 in row 214.

A casing 210 extends circumferentially about rotor assembly 118 and stator vanes 202. Stator vanes 202 are each coupled to turbine casing 210 and extend radially inward from casing 210 towards rotor shaft 112. A working fluid path 216 is defined radially inward of casing 210, and radially outward rotor disks 206 and axial spacers 203. Each row 212 of blades 204 and each row 212 of stator vanes 202 extends at least partially through working fluid path 216, such that each row 213 of axial spacers 203 forms at least a portion of a radially inner boundary of working fluid path 216.

With reference to FIGS. 1 and 2, during operation, intake section 102 channels air towards compressor section 104. Compressor section 104 compresses air and discharges compressed air into combustor section 106 and towards turbine section 108. The majority of air discharged from compressor section 104 is channeled towards combustor section 106. More specifically, pressurized compressed air is channeled to combustors 114 wherein the air is mixed with fuel and ignited to generate high temperature combustion gases. The combustion gases are channeled towards turbine section 108, wherein the gases impinge upon blades 204 to facilitate imparting a rotational force on rotor assembly 118.

Figure 3:
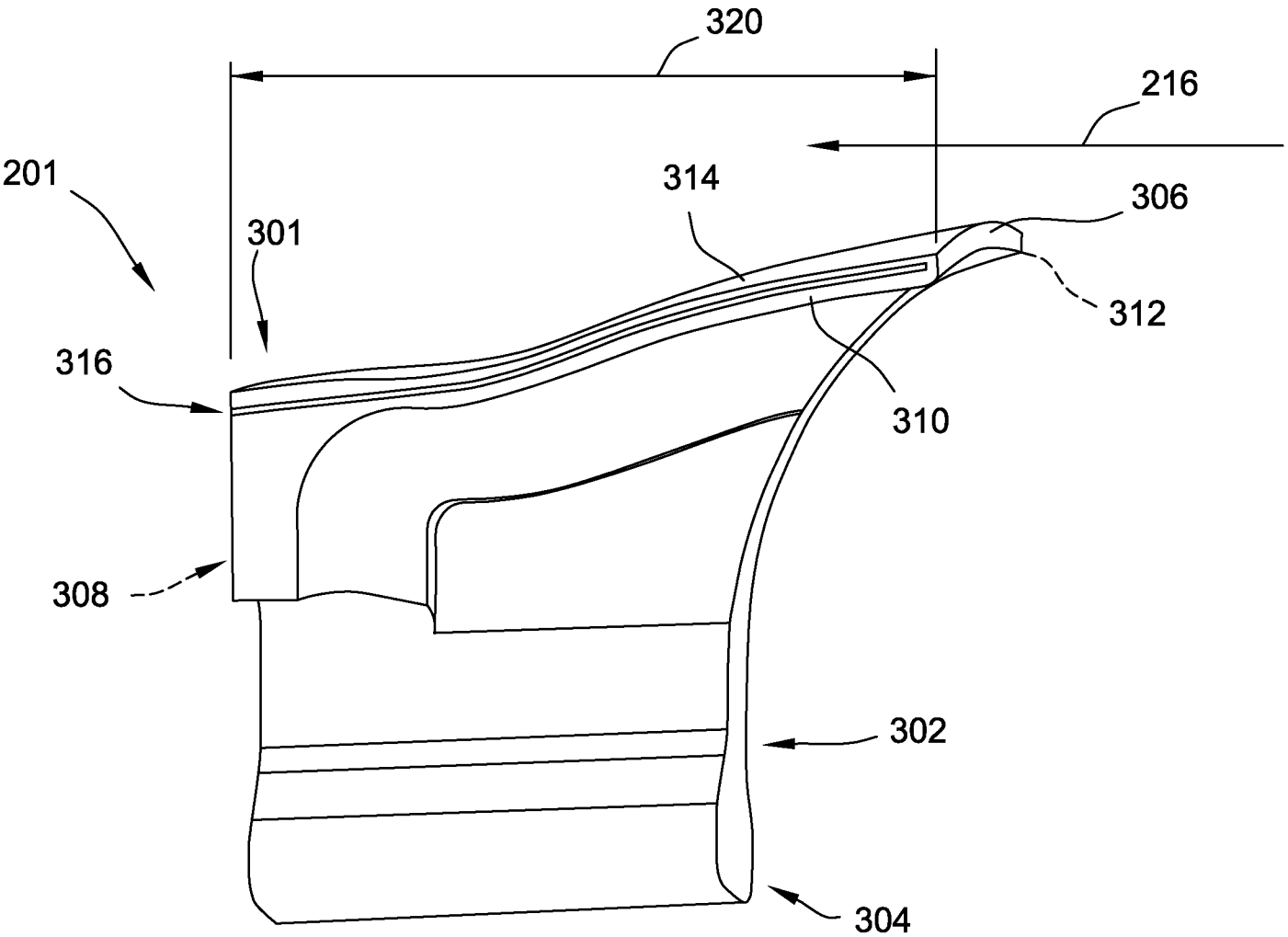
FIG. 3 is a perspective view of an exemplary rotary component that may be used with the rotor assembly shown in FIG. 2.
Figure 4:
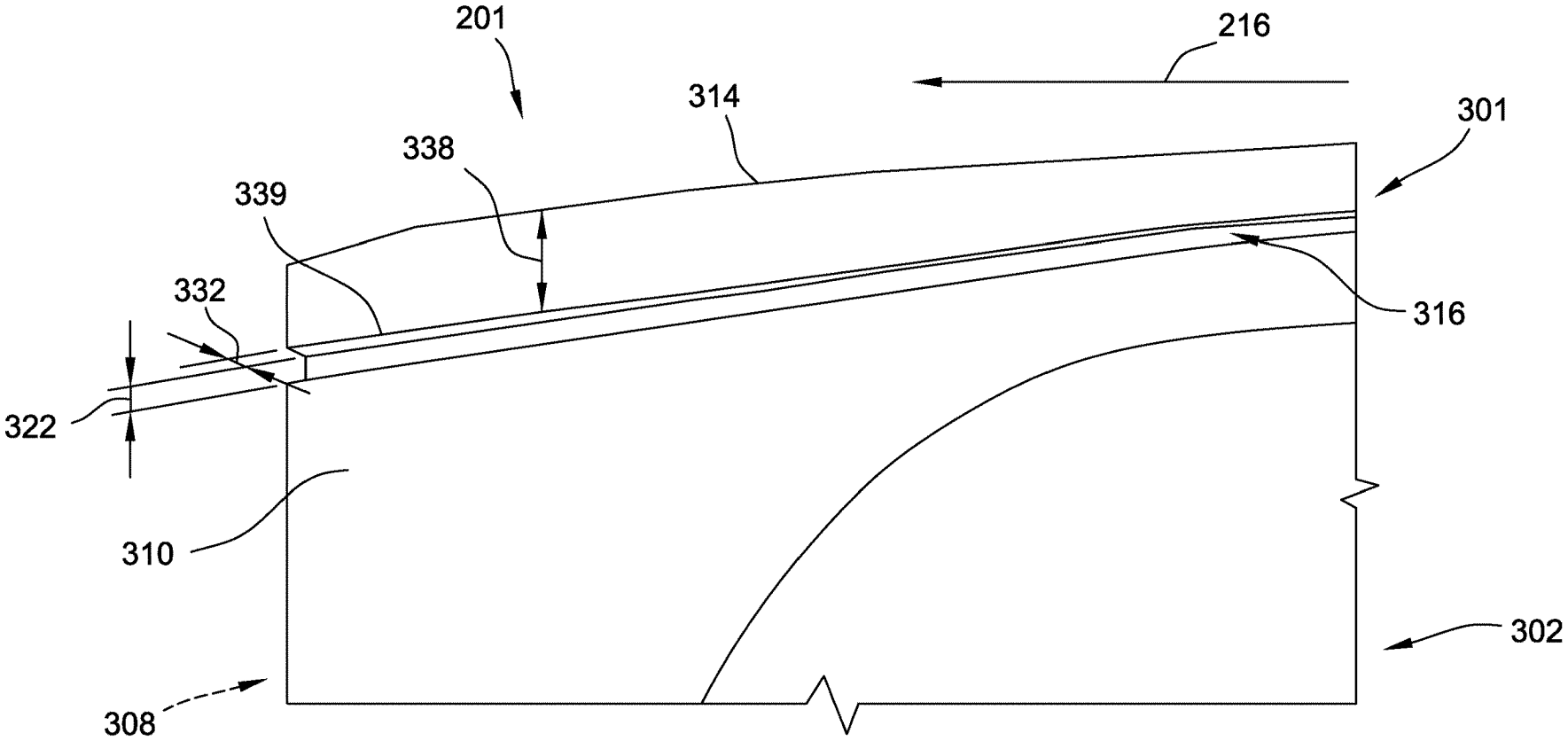
FIG. 4 is a perspective view of a portion of the rotary component shown in FIG. 3.

FIG. 3 is a perspective view of an exemplary rotary component 201 that may be used with rotor assembly 118 shown in FIG. 2. FIG. 4 is a perspective view of a portion of rotary component 201. In the exemplary embodiment, rotary component 201 is axial spacer 203. In another embodiment, rotary component 201 is blade 204. It should be understood that airfoil 218 of blade 204 is not shown in FIG. 3.

With reference to FIGS. 2-4, in the exemplary embodiment, each rotary component 201 includes a platform 301 coupled to a shank 302 that extends radially inwardly from platform 301. Each rotary component 201 also includes a dovetail region 304 that extends radially inwardly from shank 302. Dovetail region 304 is shaped to facilitate securely coupling rotary component 201 to rotor disk 206. In alternative embodiments, dovetail region 304 may have any other suitable shape that enables rotary component 201 to function as described herein.

In the exemplary embodiment, platform 301 at least partially defines a radially inner boundary of working fluid path 216. Platform 301 includes a radially outer face 314 that is suitably shaped to facilitate flow of a working fluid through working fluid path 216. Additionally, in the exemplary embodiment, platform 301 includes an upstream face 306, an opposite downstream face 308, a first side face 310, and an opposite second side face 312. Downstream face 308 and upstream face 306 each extend radially outwardly from shank 302 and laterally-between first side face 310 and second side face 312. First side face 310 defines a first side channel 316 that extends axially upstream from downstream face 308 along first side face 310, and second side face 312 defines an opposite second side channel 318 (shown in FIG. 8) that extends axially upstream from downstream face 308 along second side face 312. Each of first side channel 316 and second side channel 318 is oriented to interface with an axial seal 205. More specifically, first side channel 316 of each rotary component 201 cooperates with second side channel 318 of an adjacent rotary component 201 to receive a respective axial seal 205 therein. In alternative embodiments, rotary component 201 has any other suitable number of first side channels 316 and/or second side channels 318 that enables rotary component 201 to function as described herein.

In the exemplary embodiment, first side channel 316 is sized and shaped substantially similarly to second side channel 318. In alternative embodiments, first side channel 316 is shaped differently from second side channel 318. In the exemplary embodiment, first side channel 316 extends an axial distance 320 axially upstream along first side face 310 from an intersection with downstream face 308. Second side channel 318 also extends axial distance 320 axially upstream along second side face 312 from an intersection with downstream face 308. Each of first side channel 316 and second side channel 318 is contoured to substantially follow a profile of outer face 314. A radially upper wall 339 of first side channel 316 is spaced a radial distance 338 from outer face 314. In the exemplary embodiment, distance 338 varies along first side face 310. Similarly, a radially upper wall (not shown) of second side channel 318 is spaced a radial distance from outer face 314 and the distance varies along first side face 310. In alternative embodiments, each of first side channel 316 and second side channel 318 is spaced from outer face 314 in any suitable fashion that enables rotary component 201 to function as described herein.

Each of first side channel 316 and second side channel 318 is defined by a depth 332, a width 322, and axial length 320. In the exemplary embodiment, each first side channel 316 and second side channel 318 extends axially upstream towards, but does not reach or intersect with, upstream face 306. In alternative embodiments, each first side channel 316 and second side channel 318 extends axially upstream, such that each intersects with upstream face 306. In other alternative embodiments, each first side channel 316 and second side channel 318 may have any other suitable shape and size that enables rotary component 201 to function as described herein.

Figure 5:
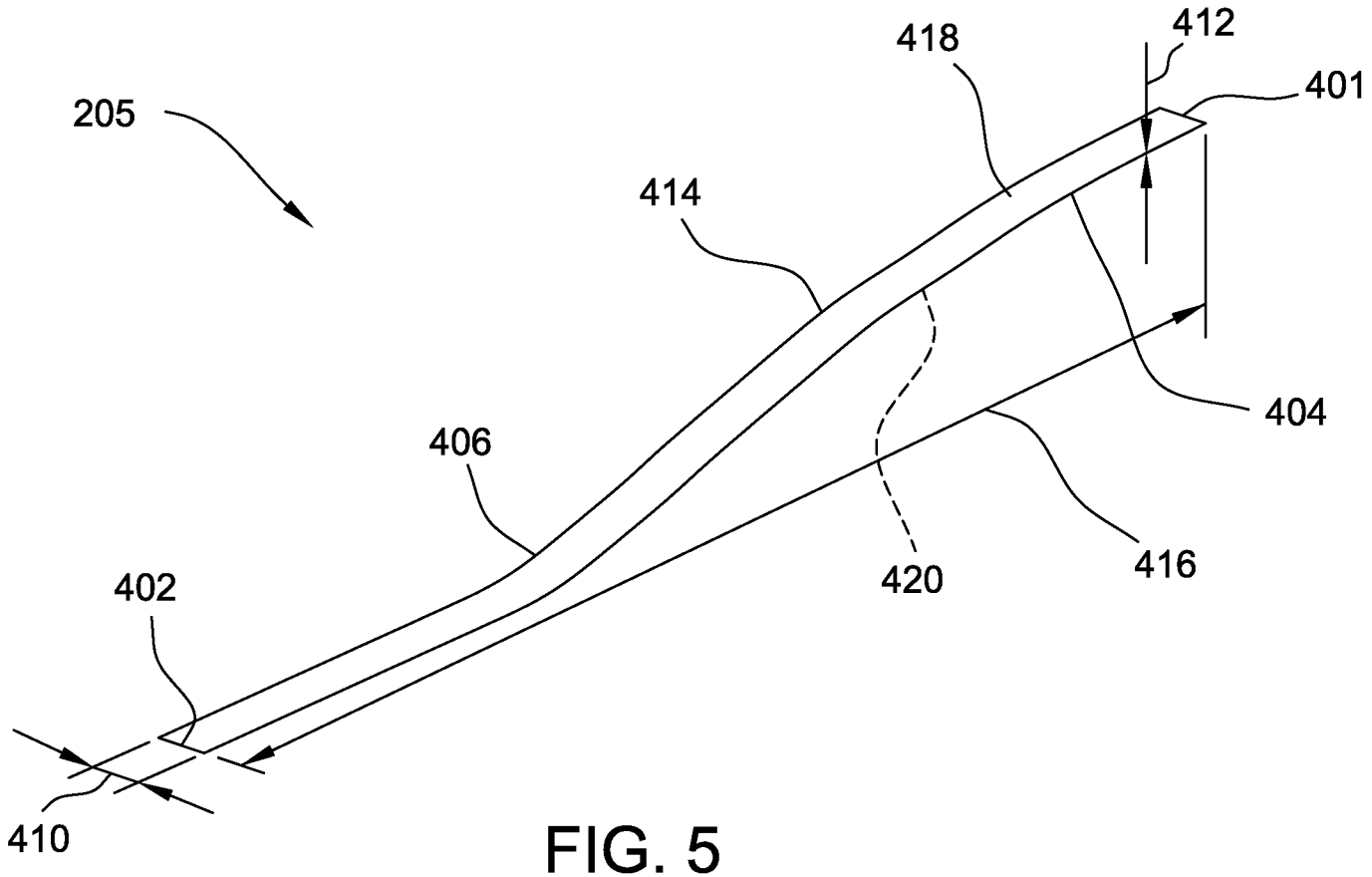
FIG. 5 is a perspective view of an exemplary axial seal that may be used with the rotor assembly shown in FIG. 2.

FIG. 5 is a perspective view of an exemplary axial seal 205 that may be used with axial spacers 203 (shown in FIG. 3). In the exemplary embodiment, axial seal 205 is sized and shaped to be received within first side channel 316 of a first rotary component 201 and second side channel 318 of an adjacent second rotary component 201. Axial seal 205 extends axially from a downstream end 402 to an upstream end 401 and defines a length 416 therebetween. In addition, axial seal 205 extends substantially radially between an inner face 420 and an outer face 418 and defines a thickness 412 therebetween, and extends laterally from a second side edge 406 to a first side edge 404 and defines a width 410 therebetween. Side edges 404 and 406 and outer and inner faces 418 and 420 cooperate to define an outer perimeter profile 414 of axial seal 205, which is sized and shaped to sealingly interface with first side channel 316 and second side channel 318 of rotary component 201 (shown in FIG. 3).

More specifically, in the exemplary embodiment, second side edge 406 of axial seal 205 is inserted into, and sealingly interfaces with, first side channel 316 of a first rotary component 201, and first side edge 404 of axial seal 205 is inserted into, and sealingly interfaces with, second side channel 318 of an adjacent second rotary component 201. In the exemplary embodiment, seal axial length 416 is approximately equal to axial length 320 of channels 316 and 318 to facilitate retaining a portion of each axial seal 205 within a pair of recessed channels 316 and 318 defined in adjacent axial spacers 203. More specifically, when axial seals 205 are inserted into channels 316 and 318, seal downstream end 402 does not extend downstream past downstream face 308 (shown in FIG. 4) of rotary component 201 during operation. In alternative embodiments, axial seal 205 includes a downstream portion (not shown) that is bent such that it interfaces with platform downstream face 308 to facilitate retaining axial seal 205 in first side channel 316 and second side channel 318.

In the exemplary embodiment, axial seal 205 is formed from a single, continuous, substantially rigid piece of material. In alternative embodiments, axial seal 205 is formed from a material having a predetermined flexibility. In other alternative embodiments, axial seal 205 is formed from multiple portions coupled together. In further alternative embodiments, axial seal 205 may have any other shape, be fabricated from any other material, have any other construction, and/or may include any number of portions (including one) that enables axial seal 205 to function as described herein.

Figure 6:
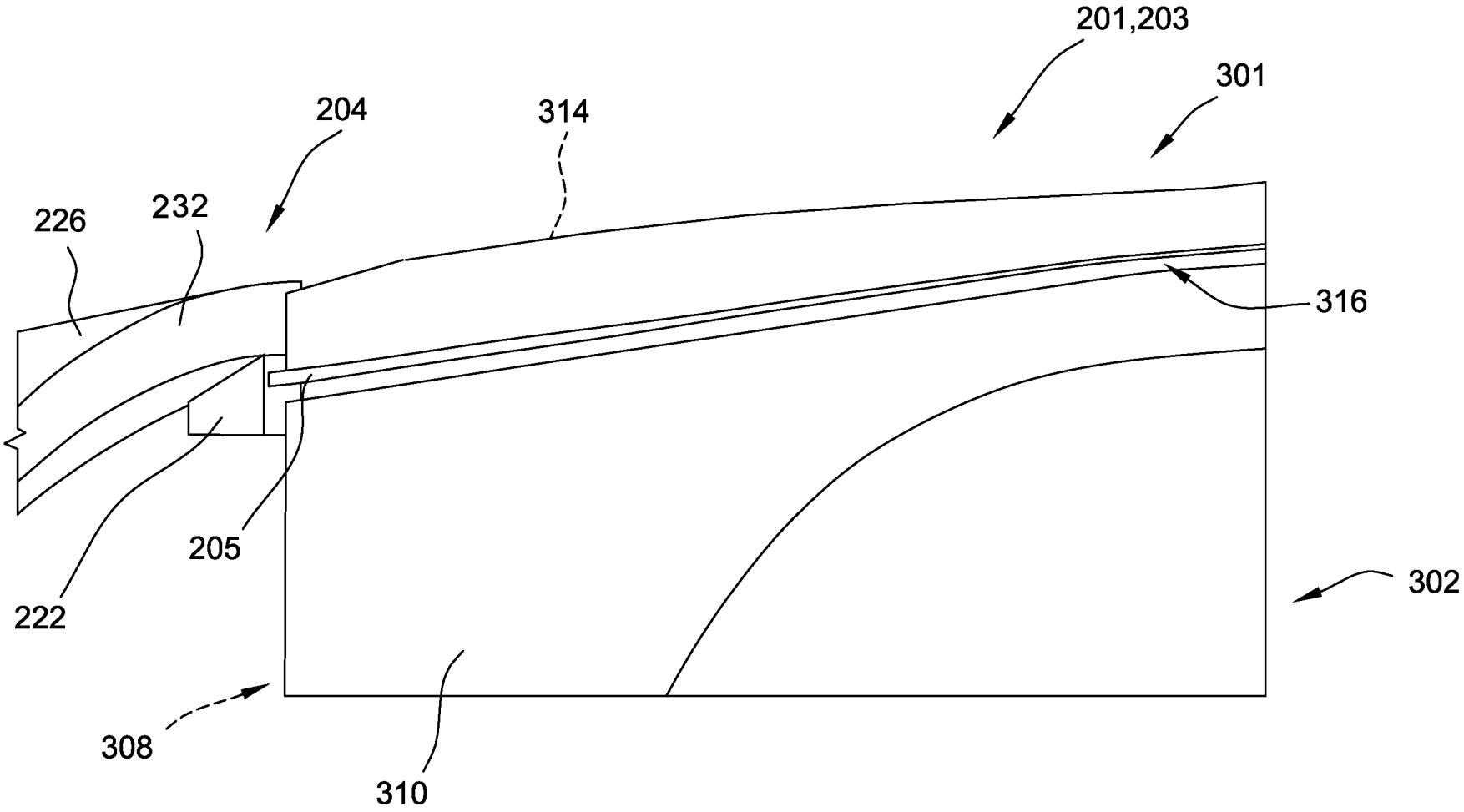
FIG. 6 is an enlarged detail view of region 6 shown in FIG. 2 illustrating an exemplary seal retainer that may be used with the rotor assembly shown in FIG. 2.

FIG. 6 is an enlarged detail view of region 6 shown in FIG. 2 illustrating an exemplary seal retainer 222, wherein rotary component 201 is axial spacer 203. In the exemplary embodiment, when rotor assembly 118 is assembled, each axial spacer 203 in row 213 is positioned axially upstream from an adjacent one of blades 204 in row 214 (shown in FIG. 2). In the exemplary embodiment, blade 204 includes a seal retainer 222 coupled to an upstream face 232 of blade platform 226. Alternatively, seal retainer 222 may be coupled to any other rotary component 201, including, without limitation, axial spacer 203. Seal retainer 222 is oriented to couple against downstream faces 308 of two circumferentially-adjacent axial spacers 203, such that the axial seal 205 received between the circumferentially-adjacent axial spacers 203 interfaces with seal retainer 222 of the axially downstream blade 204 to facilitate axial retention of axial seal 205 in first side channel 316 and second side channel 318 during operation of rotary machine 100. In alternative embodiments, seal retainer 222 may have any other suitable shape, size, and/or configuration that enables blade 204 and axial spacer 203 to function as described herein. Alternatively, rotary component 201 is blade 204, and seal retainer 222 is coupled in a substantially similar fashion to a suitable component downstream from blade 204.

Additionally or alternatively, each axial seal 205 is retained within side channels 316 and 318 of circumferentially-adjacent rotary components 201 at least partially by wires staked at each end of side channels 316 and 318. Additionally or alternatively, each axial seal 205 is bent at a respective end to facilitate retaining each axial seal 205 within side channels 316 and 318 of circumferentially-adjacent rotary components 201. Additionally or alternatively, each axial seal 205 extends downstream into an axially-adjacent downstream component to facilitate retaining each axial seal 205 within side channels 316 and 318 of circumferentially-adjacent rotary components 201.

Figure 7:
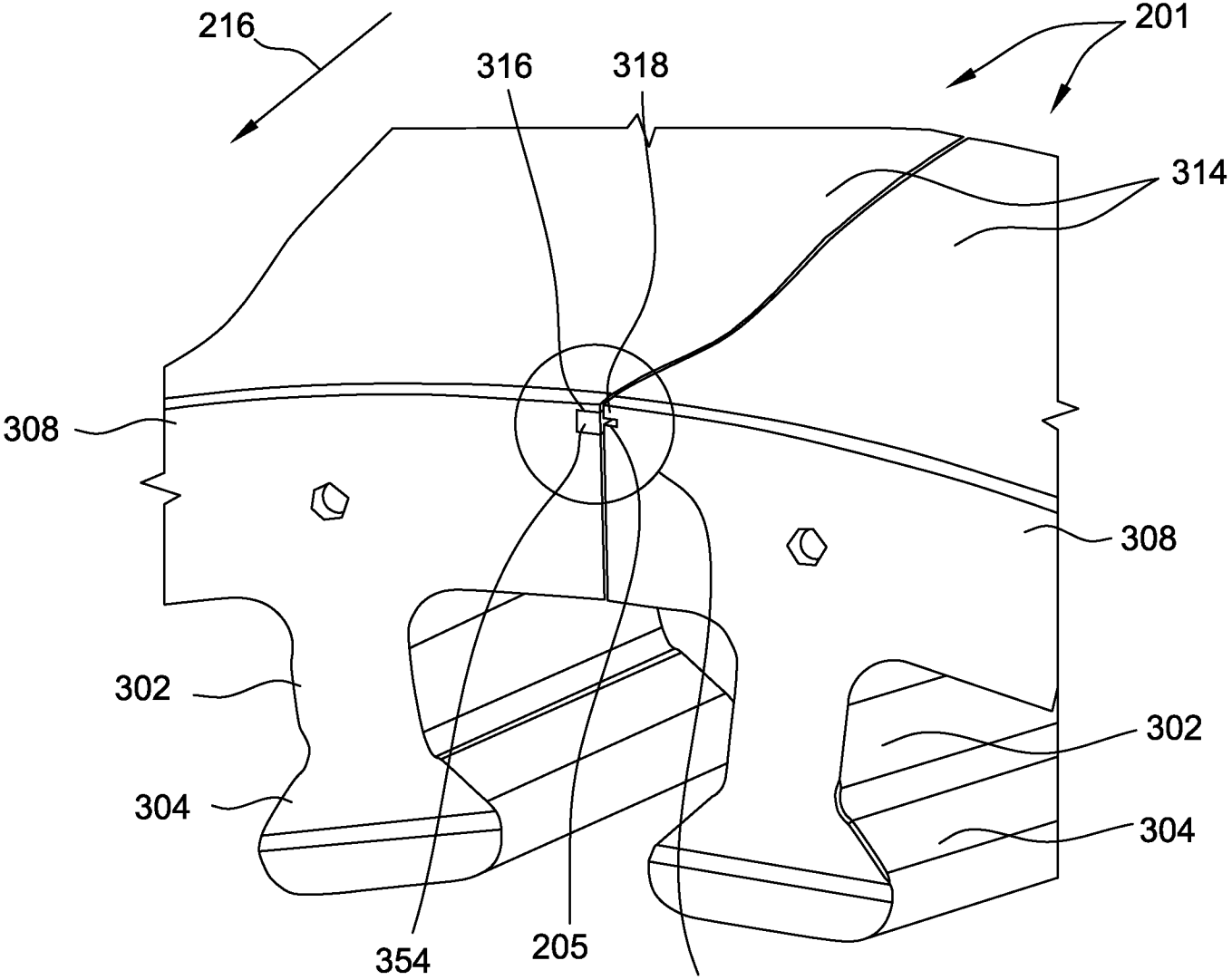
FIG. 7 is a perspective view of an exemplary channel restriction that may be used with the axial spacer shown in FIG. 3.
Figure 8:
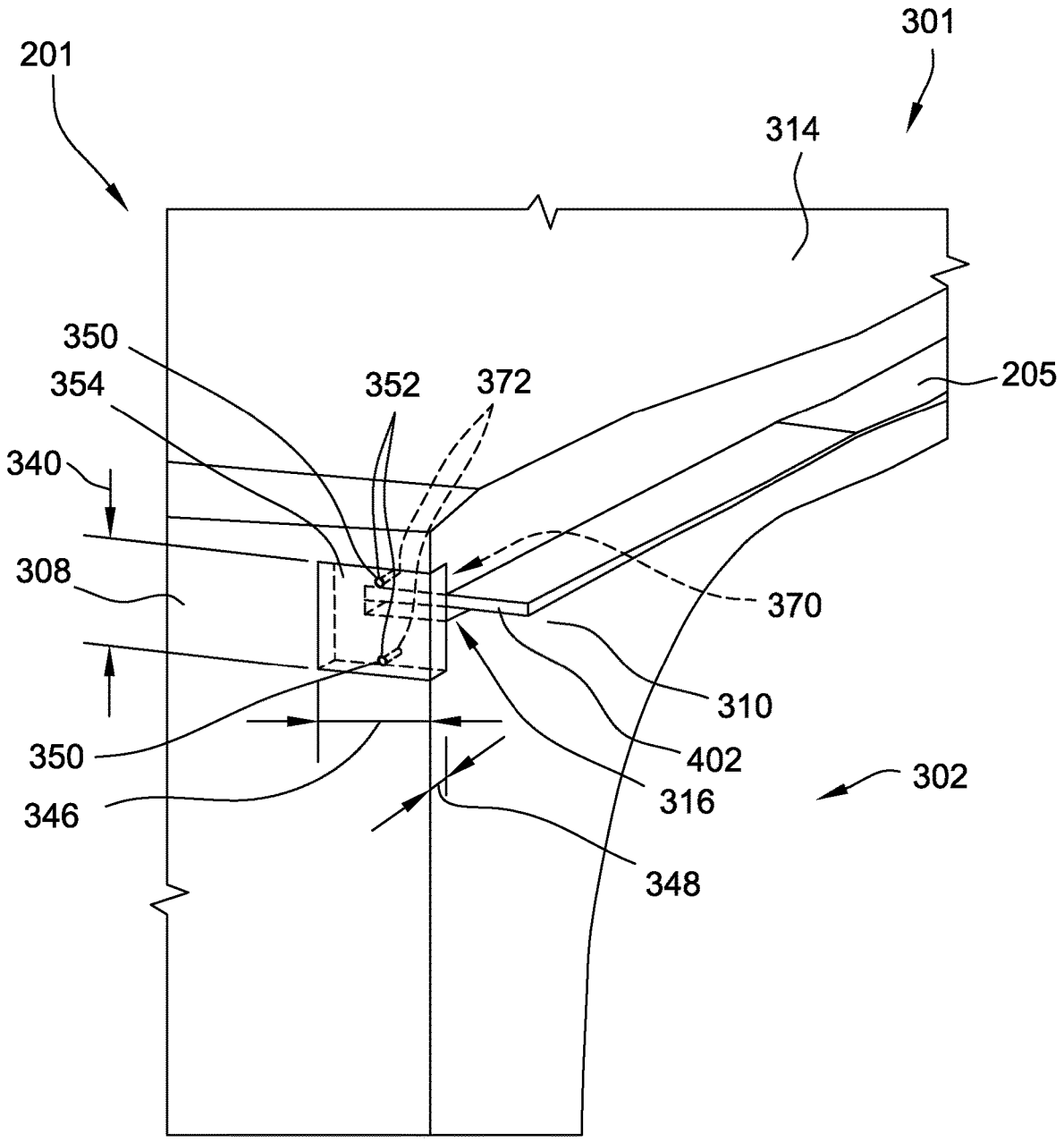
FIG. 8 is an enlarged detail view of region 8 shown in FIG. 7.

FIG. 7 is a perspective view of an exemplary channel restriction 354 positioned with respect to a pair of circumferentially-adjacent rotary components 201. FIG. 8 is an enlarged detail view of region 8 of FIG. 7. One of the circumferentially-adjacent rotary components 201 is rendered transparent in FIG. 8 for ease of description. Channel restriction 354 is coupled to downstream face 308 of platform 301 of at least one of the circumferentially-adjacent rotary components 201, adjacent to a downstream end of at least one of first side channel 316 and second side channel 318, to facilitate axial retention of axial seal 205 therewithin.

In the exemplary embodiment, channel restriction 354 extends circumferentially at least partially across a downstream end of first side channel 316, such that channel restriction 354 inhibits downstream end 402 of axial seal 205 from moving downstream out of first side channel 316 and second side channel 318. In alternative embodiments (not shown), channel restriction 354 extends circumferentially at least partially across the downstream end of second side channel 318. In some embodiments, channel restriction 354 extending across the downstream end of solely one of first side channel 316 and second side channel 318 facilitates routine movement of axial seal 205 relative to adjacent rotary components 201, while reducing or eliminating binding of axial seal 205 during operation of rotary machine 100, thereby facilitating a reduced fatigue of rotary components 201 and axial seals 205. In alternative embodiments (not shown), channel restriction 354 extends circumferentially across at least a portion of the downstream ends of both first side channel 316 and second side channel 318.

In the exemplary embodiment, channel restriction 354 is generally block-shaped. In alternative embodiments, channel restriction 354 has any suitable shape that enables channel restriction 354 to function as described herein. In the exemplary embodiment, channel restriction 354 is received in a complementary-shaped recess 370 defined in downstream face 308 of platform 301 of the first of the circumferentially-adjacent rotary components 201, such that channel restriction 354 is flush with downstream face 308. Moreover, recess 370 is defined adjacent first side face 310, such that channel restriction 354 received therein extends circumferentially at least partially across the downstream end of first side channel 316. In alternative embodiments (not shown), recess 370 is additionally or alternatively defined in a downstream face 308 of platform 301 of the circumferentially-adjacent second axial spacer 203, adjacent to second side face 312, such that channel restriction 354 received therein extends circumferentially across the downstream end of second side channel 318, as described above. In alternative embodiments, recess 370 is not defined in downstream face 308 and/or channel restriction 354 is not flush with downstream face 308.

In the exemplary embodiment, channel restriction 354 is coupled to rotary component 201 via at least one retention pin 352 inserted through a corresponding at least one opening 350 defined through channel restriction 354, and into a corresponding aligned at least one opening 372 defined in rotary component 201. In alternative embodiments, channel restriction 354 is coupled to rotary component 201 in any suitable fashion that enables channel restriction 354 to function as described herein.

In alternative embodiments, channel restriction 354 is implemented in any suitable fashion, for example, using a staking wire. In alternative embodiments, channel restriction 354 is not included.

Figure 9:
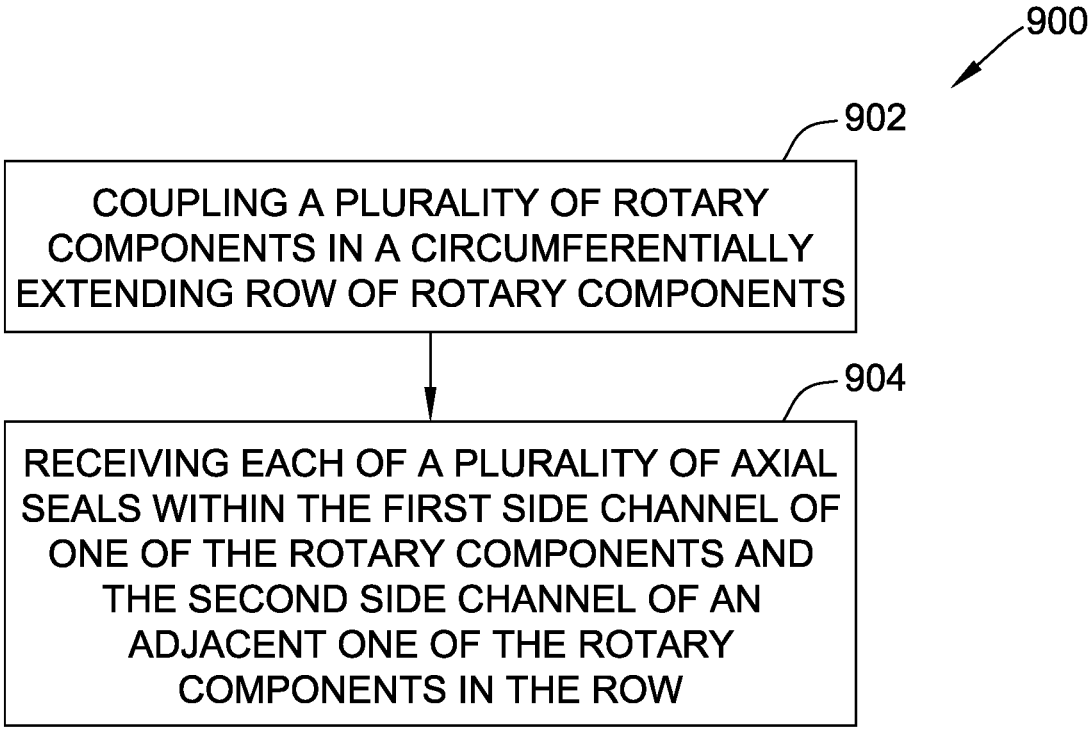
FIG. 9 is a flow diagram of an exemplary method of assembling a rotor assembly, such as the rotor assembly shown in FIG. 2.

FIG. 9 is a flow diagram of an exemplary method 900 of assembling a rotor assembly, such as rotor assembly 118 (shown in FIG. 1). In the exemplary embodiment, method 900 includes coupling 902 a plurality of rotary components 201, such as axial spacers 203 or blades 204, in a circumferentially extending row, such as row 213 or row 214, respectively. Each rotary component includes platform 301 including first side channel 316 and second side channel 318, shank 302 extending radially inwardly from platform 301, and dovetail region 304 extending radially inwardly from shank 302. Method 900 further includes receiving 904 each of a plurality of axial seals, such as axial seal 205, within the first side channel of one of the rotary components and the second side channel of an adjacent one of the rotary components in the row. Each of the axial seals is sized and shaped to sealingly interface with the first and second side channels.

The above-described embodiments of rotary components, axial seals, and axial seal retention apparatus overcome at least some disadvantages of known rotary components. Specifically, a rotary component includes a first side channel and a second side channel, and each channel is sized to receive an axial seal that is oriented to interface with adjacent channels defined in each adjacent rotary component to facilitate reducing working fluid leakage therethrough. In at least some embodiments, working fluid leakage reduction is achieved with the existing rotor disk and/or existing axially-adjacent components of the rotor. Thus, in some embodiments, the other components of a selected compressor design need not be modified to accommodate embodiments of the rotary components described herein.

Exemplary embodiments of a rotary component apparatus for use in a gas turbine engine are described above in detail. The apparatus are not limited to the specific embodiments described herein, but rather, components of systems may be utilized independently and separately from other components described herein. For example, the apparatus may also be used in combination with other rotary machines and methods, and are not limited to practice with only the gas turbine engine assembly as described herein. Rather, the exemplary embodiment can be implemented and utilized in connection with many other rotary machine applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A scaling system for a rotary machine, said sealing system comprising:

a pair of circumferentially-adjacent rotary components, each of said rotary components comprising:

a platform comprising a first side face, an opposite second side face, and a radially outer face that extends between the first and second side faces, said first side face extending along a platform length of said platform, said first side face comprising an upper wall and a lower wall spaced a width from said upper wall, said upper and lower walls extending along a channel length extending along at least a portion of said platform length and defining a first side channel, said second side face defining a second side channel, said radially outer face is shaped to facilitate guiding a flow of a working fluid along said platform length of said platform;

a shank extending radially inwardly from said platform;

a dovetail region extending radially inwardly from said shank;

an axial seal sized and shaped to be received in said first side channel of a first of said rotary components and said second side channel of a second of said rotary components, such that said axial seal sealingly interfaces with said first and second side channels along only said channel length, wherein said upper wall is spaced radially from said radially outer face; and a channel restriction coupled to said platform via at least one retention in inserted through a corresponding opening defined through said channel restriction and into a corresponding at least one opening defined in one of said rotary components.

2. The sealing system according to claim 1, wherein said first side channel and said second side channel extend axially upstream from a downstream face of said platform.

3. The sealing system according to claim 2, wherein at least one of said rotary components further comprises said channel restriction coupled to said downstream face of said platform to facilitate retaining said axial seal within at least one of said first side channel and said second side channel.

4. The sealing system according to claim 3, wherein said channel restriction is block-shaped.

5. The sealing system according to claim 2, wherein said axial seal comprises a bent portion configured to interface with said downstream face of said platform of at least one of said rotary components to facilitate retaining said axial seal within at least one of said first side channel and said second side channel.

6. The sealing system according to claim 1, wherein said axial seal is configured to interface with an axially downstream component to facilitate retaining said axial seal in said first side channel and said second side channel.

7. The sealing system according to claim 1, wherein said axial seal comprises a flexible material.

8. The sealing system according to claim 1, wherein each said rotary component is one of a blade and an axial spacer.

9. A rotor assembly for a rotary machine comprising: a row of rotary components spaced circumferentially about a rotor disk, each said rotary component comprising:

a platform comprising a first side face, an opposite second side face, said first side face extending along a platform length of said platform, the first side face comprising an upper wall and a lower wall spaced a width from said upper wall, said upper and lower walls extending along a channel length which extends along at least a portion of said platform length and defining a first side channel, said second side face defining a second side channel;

a shank extending radially inwardly from said platform;

a dovetail region extending radially inwardly from said shank;

a plurality of axial seals, each of said axial seals sized and shaped to be received in, and sealingly interface with, said first side channel of one of said rotary components and said second side channel of an adjacent one of said rotary components, and wherein axial seal extends along said first side channel and said second side channel, along only the channel length; and a channel restriction coupled to said platform via at least one retention in inserted through a corresponding opening defined through said channel restriction and into a corresponding at least one opening defined in one of said rotary components.

10. The rotor assembly of claim 9, wherein said first side channel and said second side channel extend axially upstream from a downstream face of said platform.

11. The rotor assembly of claim 10, wherein each said rotary component comprises said channel restriction coupled to said downstream face of said platform to facilitate retaining at least one of said axial seals within at least one of said first side channel and said second side channel.

12. The rotor assembly of claim 11, wherein said at least one channel restriction is block-shaped.

13. The rotor assembly of claim 10, wherein each said axial seal further comprises a bent portion configured to interface with said downstream face of said platform to facilitate retaining said axial seal in said first side channel and said second side channel.

14. The rotor assembly of claim 9, wherein each said axial seal is configured to interface with an axially downstream component to facilitate retaining said axial seal in said first side channel and said second side channel.

15. The rotor assembly of claim 9, wherein each said axial seal comprises a flexible material.

16. The rotor assembly of claim 9, wherein each said rotary component is one of a blade and an axial spacer.

17. A method of assembling a rotor assembly, said method comprising:

coupling a plurality of rotary components in a circumferentially extending row of rotary components, wherein each rotary component includes:

a platform including a first side face, an opposite second side face, and a radially outer face that extends between the first side face and the second side face, the first side face extending along a platform length of the platform, the first side face including an upper wall and a lower wall spaced a width from the upper wall, the upper and lower walls extending along a channel length which extends along at least a portion of the platform length of the platform and defining a first side channel and said second side face defining a second side channel, said radially outer face is shaped to facilitate guiding a flow of a working fluid along the platform length of the platform;

a shank extending radially inwardly from the platform;

a dovetail region extending radially inwardly from the shank;

receiving each of a plurality of axial seals within the first side channel of one of the rotary components and the second side channel of an adjacent one of the rotary components in the row, each of the axial seals sized and shaped to sealingly interface with the first and second side channels along only the channel length, wherein the upper wall is spaced radially from said radially outer face; and coupling at least one channel restriction to said platform via at least one retention pin inserted through a corresponding opening defined through said channel restriction and into a corresponding at least one opening defined in one of said rotary components.

18. The method of claim 17, wherein said coupling the rotary components further comprises coupling rotary components that each include the first side channel and the second side channel within the row of components such that the first and second channels extend axially upstream from a downstream face of the platform.

19. The method of claim 18, wherein said coupling at least one channel restriction to said platform further comprises coupling said at least one channel restriction to the downstream face of the platform to facilitate retaining at least one of the axial seals within at least one of the first side channel and the second side channel.

20. The method of claim 19, wherein said coupling at least one channel restriction further comprises coupling a block-shaped channel restriction to the downstream face of the platform.

* * * * *